United States Patent [19]

Larsson

[11] 4,037,305

[45] July 26, 1977

[54] METHOD FOR HYDROSTATIC EXTRUSION

[75] Inventor: Hans Gunnar Larsson, Vasteras, Sweden

[73] Assignee: Allmanna Svenska Elektriska Aktiebolaget, Sweden

[21] Appl. No.: 700,789

[22] Filed: June 29, 1976

[30] Foreign Application Priority Data

Sept. 24, 1975 Sweden ..... 7510692

[51] Int. Cl.[2] ..... B23P 17/00

[52] U.S. Cl. ..... 29/421 R; 29/235; 29/451; 29/506; 72/60; 72/258

[58] Field of Search ..... 29/421 R, 451, 506, 29/235; 72/258, 60

[56] References Cited

U.S. PATENT DOCUMENTS

| | | | |
|---|---|---|---|
| 3,286,337 | 11/1966 | Sauve | 29/421 X |
| 3,413,024 | 11/1968 | Farquhar | 29/451 UX |
| 3,631,586 | 1/1972 | Bearpark et al. | 72/60 X |
| 3,654,687 | 4/1972 | Burstrom | 29/421 |
| 3,777,362 | 12/1973 | Nilsson | 72/60 X |

*Primary Examiner*—Charlie T. Moon

*Attorney, Agent, or Firm*—Watson, Cole Grindle & Watson

[57] ABSTRACT

A compound billet for extrusion by isostatic liquid pressure which has a core and a casing with a gap therebetween is produced by applying a sealing ring with greater thickness than the gap between the core and the casing around the rear end of the core, then inserting the core into the casing, and pressing the sealing ring to stick in the gap between the core and the casing so that the sealing ring and/or the casing are deformed. The rear end of the casing is beveled inwardly.

9 Claims, 5 Drawing Figures

METHOD FOR HYDROSTATIC EXTRUSION

BACKGROUND OF THE INVENTION

1. Field of the Invention

The present invention relates to a method for extrusion of compound products starting from a billet which contains a core of one material and a casing of another material.

This is done by applying a sealing ring with greater thickness than the gap between the core and the casing around the rear end of the core, then inserting the core into the casing, and pressing the sealing ring to stick in the gap between the core and the casing so that the sealing ring and/or the casing are deformed. The rear end of the casing is beveled inwardly.

2. The Prior Art

In the production of a tubular products, the core is tubular so that a mandrel forming the hole in the tube can pass through the billet. Extrusion of compound products is described in more detail in, for example, U.S. Pat. Nos. 3,654,687 and 3,620,059.

As is clear from the above-mentioned patents, it is important that the billet is constructed so that pressure medium is prevented from penetrating between the core and the casing, since in that case no bond between the materials of the core and the casing can be obtained. The purpose of the invention is to improve the known method so that the production of billets can be simplified and made cheaper and the handling during the extrusion can be simplified and also the capacity in a given press be increased.

To be able to put together a core and a casing to form a billet, there is required a not insignificant play between the core and the casing, among other things because the casing is deformed upon the necessary annealing. It is bent and becomes oval. In a billet with an external diameter of the core of 150–160 mm there is required an internal diameter of the casing which is from 2 to 4 mm greater than the external diameter of the core. The play between the core and the casing thus becomes 1 to 2 mm. To obtain a manageable billet and a good seal there has been used in commercial production an end plug which has projected somewhat into the casing and a seal has been applied over the joint between the end plug and the casing. Between the end plug and the casing there has been a grip fit so that the plug has been fixed in the casing. This plug uses up space in the pressure chamber and must be removed and re-used. The other embodiments described require a small gap between the core and the casing, which is a disadvantage in commercial production.

SUMMARY OF THE INVENTION

Through the invention it has become possible to eliminate said end plug and, in spite of this, to obtain a manageable billet, in which the core and the casing are held well fixed in relation to each other and there is perfect sealing between the core and the casing so that pressure medium is prevented from penetrating into the gap between the core and the casing.

BRIEF DESCRIPTION OF THE DRAWINGS

The invention will be described in more detail with reference to the accompanying FIG. 1–5, showing the rear part of the core and the casing before they are joined and the rear part of the finished billet.

DESCRIPTION OF THE PREFERRED EMBODIMENTS

Figure 1:
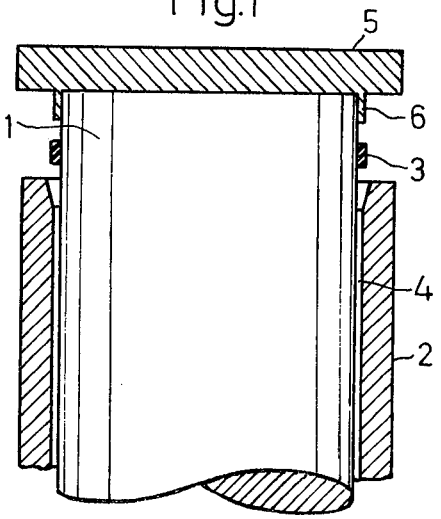
Figure 2:
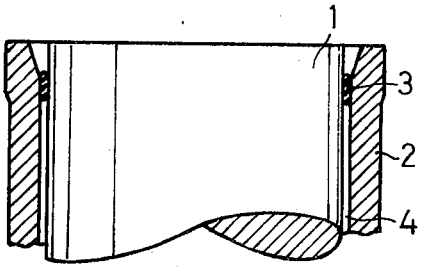

The billet according to FIGS. 1 and 2 consists of a core 1 of, for example, aluminium, a casing 2 of, for example, copper and a sealing ring 3 which prevents pressure medium from penetrating into the gap 4 between the core 1 and the casing 2 during extrusion. When a core and a casing are to be joined to form a billet there are applied, as shown in FIG. 1, a sealing ring 3 of rectangular cross-section around the billet and a plate 5 with an annular flange 6 at the rear end of the core. The flange 6 overlaps the core and fixes the seal 3 axially when the core is pushed into the casing 2. The sealing ring may be made of relatively hard polyethylene, for example of the type designated Low Density having a volume weight of about 0.91–0.94 g/cm$^3$.

The seal has the double function of axially fixing the billet, the core and the casing in relation to each other so that a manageable unit is obtained, and of preventing pressure medium from penetrating into the gap 4. In view of the joining of the core and the casing, the diametrical difference between the core and the casing must be 2–4 mm. A gap of 1–2 mm is normally formed but larger gaps may occur. The smallest possible gap is aimed at since, within a given volume, the greatest possible amount of material in the billet is aimed at. The seal must be able to withstand a pressure of about 10 MPa without being axially displaced in the gap. At this pressure, as a rule the casing has been pressed against the core so that the sealing ring cannot be displaced. When using the material mentioned, the thickness of the sealing ring should be 1–2 mm greater than the width of the gap, and the width of the sealing ring should be greater than its thickness. The ring has suitably a rectangular cross-section with a long side which is about 1.5–2 times its short side. As is clear from the figures, the seal is so hard that the casing is somewhat deformed when the seal is pressed in. The seal is very strictly clamped between the core and the casing, thus being capable of absorbing very great axial loads.

Figure 3:
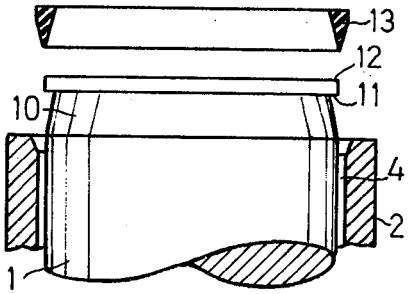
Figure 4:
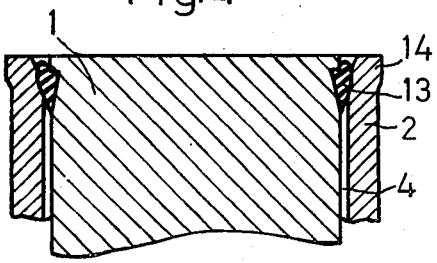

In the billet according to FIGS. 3 and 4 the core is formed with an annular groove 10 with a shoulder 11. A ring 13 is fitted over the rearmost part 12 of the core. The shoulder 11 fixed the ring 13 axially when a core with a sealing ring is inserted into a casing. The rear end 14 of the casing is somewhat expanded when the core is pressed in. The sealing ring forms a wedge between sloping walls formed of the bottom of the groove 10 and the deformed casing part 14.

Figure 5:
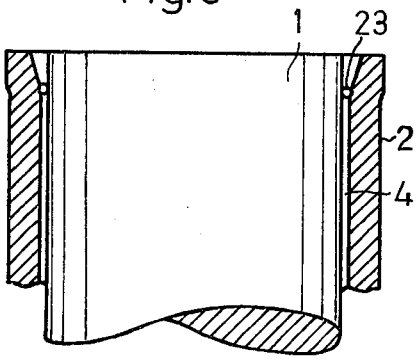

In the billet according to FIG. 5, a metallic sealing ring 23 is used. When the billet is put together, a plate 5 as shown in FIG. 1 can be used for fixing the sealing ring axially. The ring must have such a thickness that an impression is obtained in the core, and an impression and a certain expansion are obtained in the casing. This impression should be of such a magnitude that a complete contact is obtained between the sealing ring, the casing and the core around the entire circumference. The drawing shows a ring 23 with a circular cross-section, but other cross-sections can be used as well. The rear end of the casing can, after the insertion of the sealing ring, be circumferentially deformed (in direction) against the core.

I claim:

1. Method for manufacturing rod-shaped compound products by hydrostatic extrusion of a compound billet containing a core of a first material and a casing, surrounding the core, of a second material, with a gap between the casing and the core, which comprises applying a sealing ring (3,13,23) with greater thickness than the gap (4) between the core and the casing around the rear end of the core (1), inserting the core (1) into the casing (2), then pressing the sealing ring (3,13,23) to stick in the gap (4) between the core (1) and the casing (2) so that the sealing ring (3, 13, 23) and/or the casing (2) are deformed, inserting the billet formed of the core (1) and the casing (2) into a hydrostatic extrusion press and forming the billet under the influence of a liquid into an elongated product by pressing it through a die opening.

2. Method according to claim 1, in which the rear end of the casing (2) is bevelled internally so that the inner diameter at the end surface becomes greater than the diameter of the sealing ring (3, 13, 23).

3. Method according to claim 1, in which the rear end of the casing after the insertion of the sealing ring is circumferentially deformed against the core.

4. Method according to claim 1, in which the core (1) is provided with an annular groove (10) with an annular support surface (11) which axially fixes the sealing ring (13) when the core and the casing are joined together.

5. Method according to claim 1, in which, for a billet with a core (1) having a diameter of about 150–200 mm, the inner diameter of the casing (2) in 2—4 mm greater than the diameter of the core (1) and the thickness of the seal (3) exceeds the thickness of the gap by 1–2 mm.

6. Method according to claim 5, in which the width of the sealing ring (3) is greater than its thickness.

7. Method according to claim 5, in which the sealing ring (3) is formed of polyethylene.

8. Method according to claim 1, in which the sealing ring (23) is a metal ring which has such a thickness that the casing (2) is expanded by the ring (23) and an impression of the core is obtained so that metallic contact is obtained between the ring (23) and the core (1) and the casing (2) around the entire sealing ring (23).

9. Method according to claim 1, in which a ring of metal and one of plastic material are used, the metal ring being placed in the innermost part and forming a support for the plastic ring.

* * * * *